US011512371B2

(12) United States Patent
Park et al.

(10) Patent No.: US 11,512,371 B2
(45) Date of Patent: Nov. 29, 2022

(54) BCC DUAL PHASE REFRACTORY SUPERALLOY WITH HIGH PHASE STABILITY AND MANUFACTURING METHOD THEREFORE

(71) Applicant: Seoul National University R&DB Foundation, Seoul (KR)

(72) Inventors: Eun Soo Park, Seoul (KR); Sang Jun Kim, Seoul (KR); Ji Young Kim, Seoul (KR); Hyun Seok Oh, Seoul (KR); Kook Noh Yoon, Seoul (KR)

(73) Assignee: SEOUL NATIONAL UNIVERSITY R&DB FOUNDATION, Seoul (KR)

( * ) Notice: Subject to any disclaimer, the term of this patent is extended or adjusted under 35 U.S.C. 154(b) by 127 days.

(21) Appl. No.: 16/996,787

(22) Filed: Aug. 18, 2020

(65) Prior Publication Data

US 2021/0301375 A1 Sep. 30, 2021

(30) Foreign Application Priority Data

Mar. 27, 2020 (KR) ..... 10-2020-0037385

(51) Int. Cl.
*C22C 30/00* (2006.01)
*C22C 21/00* (2006.01)
*C22C 1/02* (2006.01)

(52) U.S. Cl.
CPC ..... *C22C 30/00* (2013.01); *C22C 1/026* (2013.01); *C22C 21/00* (2013.01)

(58) Field of Classification Search
None
See application file for complete search history.

(56) References Cited

PUBLICATIONS

Das et al. "Order-disorder transformation of the body centered cubic phase in the Ti—Al-X (X = Ta, Nb, or Mo) system." Journal of Materials Science 38 (2003) 3995-4002. (Year: 2003).*

(Continued)

*Primary Examiner* — Brian D Walck
(74) *Attorney, Agent, or Firm* — Lex IP Meister, PLLC

(57) ABSTRACT

Disclosed are a BCC dual phase refractory superalloy with high phase stability and a manufacturing method therefor, the alloy comprising one or more of Ti, Zr, and Hf as Group 4 transition metals, one or more of Na and Ta as Group 5 transition metals, and Al, and having a structure of a BCC phase, wherein the BCC phase is composed of a disordered BCC phase and an ordered BCC phase, and wherein the ordered BCC phase is formed by allowing Al, which is a BCC phase forming element, to be soluted in an area of the BCC phase where the contents of the Group 5 transition metals are more than those of the Group 4 transition metals, so that the present disclosure provides a BCC dual phase refractory superalloy with high phase stability, characterized in that when a BCC dual phase with the ordered BCC phase and the disordered BCC phase separated from each other is formed by aging, the aging condition is precisely controlled through the apex temperature ($T_c$) of the BCC phase miscibility gap, expressed by (Equation 1) below.

$$T_c(K)=881.4+331.7*x+546.7*y+893.0*x*z \text{ (provided that, } 0\le x\le 1,\ 0\le y\le 0.2,\ 0\le x+y\le 1, \text{ and } 0\le z\le 1) \quad \text{(Equation 1)}$$

8 Claims, 7 Drawing Sheets

(56) References Cited

PUBLICATIONS

Lin et al. "Effect of Al addition on mechanical properties and microstructure of refractory AlxHfNbTaTiZr alloys." Journal of Alloys and Compounds 624 (2015) 100-107. (Year: 2015).*
Senkov et al. "Effect of aluminum on the microstructure and properties of two refractory high-entropy alloys." Acta Materialia 68 (2014) 214-228. (Year: 2014).*

* cited by examiner

BCC DUAL PHASE REFRACTORY SUPERALLOY WITH HIGH PHASE STABILITY AND MANUFACTURING METHOD THEREFORE

CROSS REFERENCE TO RELATED APPLICATION

This application claims priority from Korean Patent Application No. 10-2020-0037385, filed on Mar. 27, 2020, which is hereby incorporated by reference for all purposes as if fully set forth herein.

BACKGROUND OF THE INVENTION

1. Field of the Invention

The present disclosure relates to a BCC dual phase refractory superalloy with high phase stability and a manufacturing method therefor.

2. Description of the Prior Art

In general, materials, such as gas turbine blades, used in complex and extreme environments having low temperature-high temperature cycles and high pressures, require excellent mechanical characteristics at high temperatures. A Ni-based superalloy is mainly used as a representative extreme environment material due to excellent yield strength thereof at high temperatures. The Ni-based superalloy has an FCC dual phase of order-disorder FCC combined structure. Specifically, the Ni-based superalloy has a solid solution FCC austenite (γ) phase with excellent ductility as a matrix and γ'($Ni_3$ (Al,Cr)), which is an ordered FCC $Ll_2$ phase with high strength as precipitates, thereby retaining excellent mechanical properties.

However, the Ni-based superalloy has limitations in use thereof since the Ni-based superalloy is softened at a temperature of 800° C. or higher due to a relatively low melting point thereof, resulting in rapid deteriorations in mechanical properties. Therefore, the development of high-temperature structural materials that can be stably utilized even at an ultra-high temperature of 1000° C. or higher is needed.

Since refractory high entropy alloys composed of Groups 4 to 6 transition metals and having a body centered cubic crystal structure are recently known to have superior high-temperature mechanical properties to existing superalloys at a high temperature of 800° C. or higher, various studies on the refractory high entropy alloys are being conducted.

The term high entropy alloy refers to an alloy having high configurational entropy through a plurality of main elements. In recent years, refractory metal-based high entropy alloys, which realize a dual phase having a nano-sized cubic structure of precipitates, found in the Ni-based superalloys, on the basis of high entropy alloy designing, have been presented, and have been receiving attention as a next-generation ultra-high temperature structural material due to very excellent room-temperature and high-temperature strength thereof (Entropy (2016, Vol. 18, p 102)).

However, in the manufacture of the high entropy superalloys thus developed, microstructures thereof are controlled by only a cooling process without aging, after ingot making and homogenization (Entropy (2016, Vol. 18, p 102), Materials and Design (2018, Vol. 139, pp. 498-511)). However, such a cooling process is not suitable for the production of larger products with a size of several centimeters or more since the cooling rate varies depending on the size of a material and the cooling rate varies according to the location of the material. The aging, by which heat treatment is carried out at a particular temperature for a long time, is suitable in controlling microstructures. It was also reported that some alloys show the BCC dual phase by aging at 600° C. but not by aging at 800° C. (Journal of Materials Research (2018, Vol. 33, pp, 3235-3246)), and the reason is that the high-temperature phase stability of the BCC dual phase structure is low. Therefore, this fact means that when a material is exposed to such a high-temperature environment, properties of the material change and thus the material cannot be used as a high-temperature material.

The reason why the aging of a refractory superalloy is difficult is that various types of elements constitute the alloy, and the phase stability of the BCC dual phase varies depending on the types and contents of the elements, resulting in different aging-possible temperatures, and the method of controlling aging is not been known.

Accordingly, there is a need for the development of a refractory superalloy, which has high phase stability of the BCC dual phase and thus can form a BCC dual phase through aging at a high temperature of 600° C. or higher.

PRIOR ART DOCUMENTS

Non-Patent Documents (Non-Patent Document 1) Entropy (2016, Vol. 18, p 102)
(Non-Patent Document 2) Materials and Design (2018, Vol. 139, pp. 498-511)
(Non-Patent Document 3) Journal of Materials Research (2018, Vol. 33, pp, 3235-3246)

SUMMARY OF THE INVENTION

The present disclosure has been made in order to solve the above-mentioned problems in the prior art and an aspect of the present disclosure is to provide a BCC dual phase refractory superalloy with high phase stability and a manufacturing method therefor, wherein the refractory superalloy has a multiple major element ordered-disordered BCC dual phase capable of being stably utilized even at an ultra-high temperature of 1000° C. or higher, can control a dual phase on the basis of the prediction of the apex temperature of the BBC phase miscibility gap at the time of aging, and has two phases being thermodynamically stable even at a high temperature of 600-1300° C.

According to the present disclosure, a BCC dual phase refractory superalloy with high phase stability at high temperatures has the following features:

the BCC dual phase refractory superalloy comprises one or more of Group 4 transition metals, one or more of Group 5 transition metals, and Al, and has a structure of a BCC phase;

the BCC phase is composed of a disordered BCC phase and an ordered BCC phase; and the ordered BCC phase is formed by allowing Al, which is a BCC phase forming element, to be soluted in an area of the BCC phase where the contents of the Group 5 transition metals are more than those of the Group 4 transition metals.

The Group 4 transition metals are preferably one or more of Ti, Zr, and Hf and the Group 5 transition metals are preferably one or more of Nb and Ta.

In addition, the alloy of the present disclosure is composed of the following composition:

$((Ti_{1-x-y}Zr_xHf_y)_{1-a}(Nb_{1-z}Ta_z)_a)_{100-b}Al_b$ ($0 \le x \le 1$, $0 \le y \le 0.2$, $0 \le x+y \le 1$, $0 \le z \le 1$, $0.4 \le a \le 0.7$, and $5 \le b \le 20$ at. %)

The ordered BCC phase may be a B2 phase precipitated from the disordered BCC phase.

The refractory superalloy of the present disclosure, when being composed of at least five major elements including Al, has a composition around the apex of the BCC phase miscibility gap in a pseudo-binary phase diagram of $(Ti_{1-x-y}Zr_xHf_y)$—$(Nb_{1-z}Ta_z)$. Therefore, the refractory superalloy of the present disclosure has especially high phase stability at high temperatures.

In the present disclosure, the maximum temperature ($T_c$) of the miscibility gap may be predicted by (Equation 1) below.

$$T_c(K)=881.4+331.7*x+546.7*y+893.0*x*z \ (0\le x\le 1,\ 0\le y\le 0.2,\ 0\le x+y\le 1, \text{ and } 0\le z\le 1) \quad \text{(Equation 1)}$$

Meanwhile, the refractory superalloy of the present disclosure has a BCC dual phase of a disordered BCC phase and an ordered BCC phase with large contents of (Ti, Zr, Hf).

The ordered BCC phase is preferably a B2 phase formed by allowing Al to be soluted in the BCC phase with large contents of (Ti, Zr, Hf).

In the present disclosure, the ordered BCC phase forming element is preferably aluminum. Aluminum is added in 5-20 at. % to thereby allow the BCC phase with large contents of (Ti, Zr, Hf) of the two separated BCC phases to be formed into a B2 phase as an ordered BCC phase.

The BCC dual phase refractory superalloy with high phase stability according to the present disclosure has a microstructure including both of two BCC phases, wherein the precipitated BCC phase has an average particle size of 0.01-100 μm.

The BCC dual phase refractory superalloy with high phase stability according to the present disclosure has further enhanced strength by adding at least one selected from the group consisting of (Mo and W) in 10 at. % or less, through a solid solution strengthening effect by a difference in atomic radius.

The BCC dual phase refractory superalloy with high phase stability according to the present disclosure has further improved oxidation resistance by adding at least one of the group consisting of (Cr and Si), which have significantly large affinity with oxygen compared with constituent elements, in 5 at. % or less.

Meanwhile, the BCC dual phase refractory superalloy with high phase stability according to the present disclosure is manufactured by the following steps:

preparing a raw material having a composition of $((Ti_{1-x-y}Zr_xHf_y)_{1-a}(Nb_{1-z}Ta_z)_a)_{100-b}Al_b$ ($0\le x\le 1$, $0\le y\le 0.2$, $0\le x+y\le 1$, $0\le z\le 1$, $0.4\le a\le 0.7$, and $5\le b\le 20$ at. %);

melting the raw material to prepare an alloy;

homogenizing the prepared alloy to form a BCC single phase; and aging the alloy with the single phase to form a BCC dual phase.

In the homogenizing step, heat treatment is carried out at a heat treatment temperature of 1300-1600° C. for 1-96 hours, followed by quenching. Thereby, a microstructure of the BCC single phase can be obtained.

The single phase BCC is separated into two BCC phases through heat treatment at a heat treatment temperature of 600-1300° C. for 1-200 hours on the basis of the prediction of the maximum temperature ($T_c$) of the miscibility gap of the alloy manufactured from the aging step. Therefore, a BCC dual phase can be obtained.

As set forth above, the BCC dual phase refractory superalloy with high phase stability according to the present disclosure has a BCC dual phase, and thus has excellent strength maintained at a high temperature as well as room temperature by a precipitation hardening effect. In addition, the alloy of the present disclosure has a relatively high apex temperature ($T_c$) of the BCC phase miscibility gap, thereby maintaining the temperature homeostasis of mechanical characteristics.

Furthermore, the alloy of the present disclosure can form a BCC dual phase through customized aging at a high temperature of 600-1300° C. on the basis of the prediction of the apex temperature ($T_c$) of the BCC phase miscibility gap.

The present disclosure can attain the lifetime enlargement and efficiency maximization of parts, such as gas turbine blades, used in complex extreme environments of low temperature-high temperature cycles and high pressures.

BRIEF DESCRIPTION OF THE DRAWINGS

The above and other aspects, features and advantages of the present disclosure will be more apparent from the following detailed description taken in conjunction with the accompanying drawings, in which.

DETAILED DESCRIPTION OF THE EXEMPLARY EMBODIMENTS

Hereinafter, embodiments of the present disclosure will be described with reference to the accompanying drawings.

For the manufacture of the alloys of the present disclosure, a pseudo-binary phase diagram is configured so that a plurality of major elements among the refractory elements on the periodic table can form a miscibility gap through a relationship of enthalpy of mixing. In addition, the alloy of the present disclosure can be implemented by transforming one BCC phase into a B2 phase as an ordered BCC phase through the addition of 5-20 at. % of Al to an alloy having a composition around the apex of the miscibility gap, of which phase can be separated at a high temperature. This configuration of the alloy has an advantage in that the apex temperature of the miscibility gap can be predicted according to the combination of refractory metal elements in the BCC phase miscibility gap, and the alloy shows excellent strength by strong bonding between atoms of the ordered lattice in the B2 phase.

Among the elements constituting the superalloy of the present disclosure, Ti, Zr, and Hf as Group 4 elements and Nb and Ta as Group 5 elements are known to have a positive relationship of enthalpy of mixing therebetween. Especially, in a Zr—Ta binary alloy system, the BCC phase miscibility gap where a BCC phase is separated into two BCC phases is present in the phase diagram thereof. Most of the refractory superalloys reported in the literature formed a BCC dual phase through a cooling process after ingot making and homogenization, and such a dual phase is generated at the temperature in the BCC miscibility gap in the cooling and aging process. However, the reason why the BCC dual phase is not formed after aging at a high temperature of 800° C. or higher is that the BCC miscibility gap is located at 800° C. or lower in the corresponding alloy composition.

In the present study, a pseudo-binary phase diagram of $(Ti_{1-x-y}Zr_xHf_y)$—$(Nb_{1-z}Ta_z)$ was configured by grouping Group 4 transition metal elements and Group 5 transition metal elements having a positive relationship of enthalpy of mixing therebetween. The position ($X_{Tc}$ and $T_c$ in FIG. 1) of the apex of the BCC phase miscibility gap in the pseudo binary phase diagram was determined through thermodynamic calculation. In the present study, a pseudo-binary phase diagram of $(Ti_{1-x-y}Zr_xHf_y)$—$(Nb_{1-z}Ta_z)$ was configured, and a pseudo-binary phase diagram was calculated by using TCHEA3 database of Thermo-Calc software for about 150 various combinations of x, y, and z, and then the position ($X_{Tc}$ and $T_c$) of the apex of the BCC miscibility gap was calculated. Unless otherwise stated in the present disclosure, the thermodynamic calculation was performed under the same conditions as the above.

Figure 1:
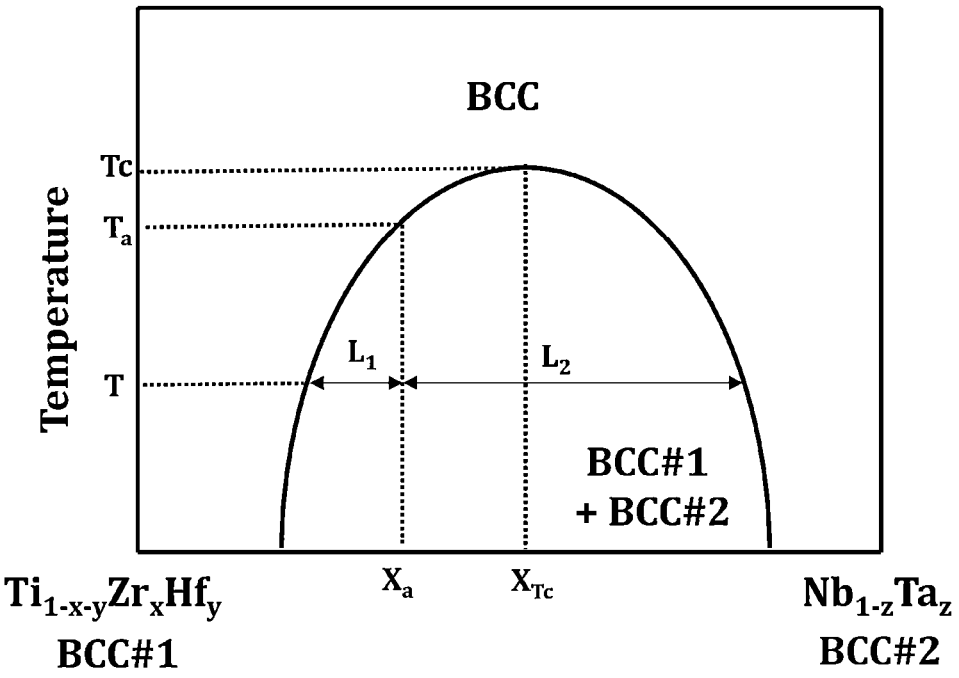
FIG. 1 is a schematic diagram of a pseudo-binary phase diagram of $(Ti_{1-x-y}Zr_xHf_y)$—$(Nb_{1-z}Ta_z)$ of the present disclosure.

FIG. 1 is a schematic diagram of a pseudo-binary phase diagram of $(Ti_{1-x-y}Zr_xHf_y)$—$(Nb_{1-z}Ta_z)$ of the present disclosure. When comparing an alloy having a composition ($X_T$c) of the apex of the BCC miscibility gap and an alloy having a composition ($X_a$) away from the apex, the composition at the apex has an advantage in that the temperature at which the BCC dual phase is thermodynamically stable is relatively high. ($T_c$>$T_a$) In addition, when aging is carried out at a particular temperature T, the equilibrium fractions of BCC #1 and BCC #2, which are two BCC phases, are expressed as a ratio of $L_2$ and $L_1$ by the lever rule. In the composition of $X_a$, as the temperature is increased, the length of $L_1$ is decreased compared with the length of $L_2$, and thus the equilibrium fraction of BCC #1 increases. This fact means that the alloy has a disadvantage that the fractions of the two BCC phases may be greatly changed. On the contrary, the alloy having a composition ($X_{TC}$) of the apex of the miscibility gap is located at the center of the miscibility gap, and thus the phase fraction does not change significantly according to the temperature, meaning that the microstructure change according to the temperature is relatively small.

Figure 2:
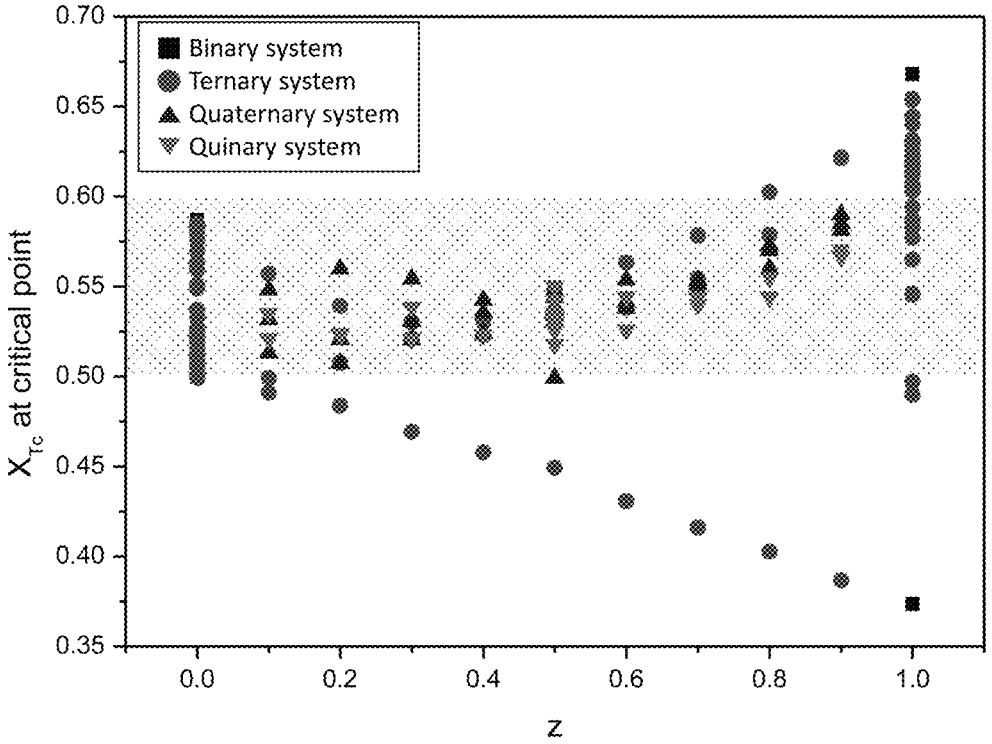
FIG. 2 is a graph showing the content ($X_7c$) of niobium and tantalum over z at the apex of the BCC phase miscibility gap in a pseudo-binary phase diagram composed of $(Ti_{1-x-y}Zr_xHf_y)$—$(Nb_{1-z}Ta_z)$, determined by thermodynamic calculation (CALPHAD)

FIG. 2 is a graph of the $(Nb_{1-z}Ta_z)$ fraction $X_{Tc}$ over z at the apex of the BCC phase miscibility gap in a pseudo-binary phase diagram of $(Ti_{1-x-y}Zr_xHf_y)$—$(Nb_{1-z}Ta_z)$ obtained by phase equilibrium calculation. When two or three alloying elements are used to configure a binary alloy system or a ternary alloy system, $X_{Tc}$ is broadly distributed between 0.35 and 0.7, and thus the tendency thereof cannot be predicted. In contrast, when four or more alloying elements are used to configure a quaternary alloy system or quinary alloy system, $X_{Tc}$ is located between 0.5 and 0.6. Therefore, when four types or more of constituent elements are used and a is set to be $0.4 \le a \le 0.7$ in the $(Ti_{1-x-y}Zr_xHf_y)_{1-a}(Nb_{1-z}Ta_z)_a$ alloy systems, the composition of an alloy, of which phase can be separated at a high temperature, can be configured to be a composition around the apex of the miscibility gap, and therefore, the high-temperature phase stability of the alloy can be increased.

The temperature $T_c$ at the apex of the miscibility gap in the pseudo-binary phase diagram of $(Ti_{1-x-y}Zr_xHf_y)$—$(Nb_{1-z}Ta_z)$ may be expressed by the following equation. The following equation is a regression equation obtained by a multiple regression model for the $T_c$ value according to the combination of x, y, and z, calculated as above, and the coefficient of determination, $R^2$, in the regression analysis, is about 0.97, which is high enough to be relied.

$$T_c(\mathrm{K})=881.4+331.7*x+546.7*y+893.0*x*z$$

As the x, y, and z contents are increased, $T_c$ is increased, leading to high phase stability. However, Zr (6.5 g/cm$^3$), Hf (13.1 g/cm$^3$), and Ta (16.6 g/cm$^3$) have higher density than Ti (4.5 g/cm$^3$) and Nb (8.6 g/cm$^3$), thereby reducing alloy specific strength. Therefore, it is preferable to configure a low density while maintaining the BCC dual phase at a temperature to be used, by controlling the constituent elements, and the above equation can be utilized according to the temperature to be used, thereby controlling $T_c$, which is the apex temperature of the BCC phase miscibility gap of the alloy.

In a case where x and z are greater than 0 in the pseudo-binary phase diagram of $(Ti_{1-x-y}Zr_xHf_y)$—$(Nb_{1-z}Ta_z)$ of the present disclosure, the apex ($T_c$) value of the miscibility gap was 600° C. or higher and thus high-temperature stability can be secured. In a case where x is 0.3 or greater and z is 4 or greater, the $T_c$ value of the miscibility gap was 800° C. or higher and thus ultra-high-temperature stability can be secured.

Therefore, the present disclosure can provide a BCC dual phase refractory superalloy, which has high high-temperature phase stability in the BCC dual phase since the apex temperature ($T_c$) of the miscibility gap of a BCC phase formed by a composition of (Equation 2) below is 800° C. or higher.

$$((Ti_{1-x-y}Zr_xHf_y)_{1-a}(Nb_{1-z}Ta_z)_a)_{100-b}Al_b \text{(provided that, } 0.3 \le x \le 1,\ 0 \le y \le 0.2,\ 0 \le x+y \le 1,\ 0.4 \le z \le 1,\ 0.4 \le a \le 0.7, \text{ and } 5 \le b \le 20 \text{ at. \%)} \quad \text{(Equation 2)}$$

The alloy of the present disclosure, when x is 0.5 or greater and z is 0.5 or greater, has a $T_c$ value of 1000° C. or higher in the miscibility gap and thus can secure ultra-high-temperature stability.

Therefore, the present disclosure can provide a BCC dual phase refractory superalloy, which has excellent ultra-high-temperature stability in the BCC dual phase since the apex temperature ($T_c$) of the miscibility gap of a BCC phase formed by a composition of (Equation 3) below is 1,000° C. or higher.

$$((Ti_{1-x-y}Zr_xHf_y)_{1-a}(Nb_{1-z}Ta_z)_a)_{100-b}Al_b \text{(provided that, } 0.5 \le x \le 1,\ 0 \le y \le 0.2,\ 0 \le x+y \le 1,\ 0.5 \le z \le 1,\ 0.4 \le a \le 0.7, \text{ and } 5 \le b \le 20 \text{ at. \%)} \quad \text{(Equation 3)}$$

The high-temperature stability and ultra-high-temperature stability mean that an alloy is exposed to a temperature equal to or lower than the apex of the miscibility gap and thus the phase change of the BCC dual phase of the present disclosure does not occur. Here, pure Hf has a relatively higher density (13.1 g/cm$^3$) than other elements and has a thermodynamically stable HCP phase up to a high temperature of 2015 K, and therefore, the y value that determines the Hf content in the (Ti, Zr, Hf) element group is preferably 0.2 or smaller. When the alloy composition is delimited as above, a quaternary or quinary alloy system can be configured, and thus the $(Nb_{1-z}Ta_z)$ fraction ($X_{Tc}$) at the apex of the miscibility gap can be positioned in 0.5 to 0.6 as described above.

According to the present disclosure by the above description, a BCC dual phase refractory superalloy with high phase stability, which has a chemical formula of $((Ti_{1-x-y}Zr_xHf_y)_{1-a}(Nb_{1-z}Ta_z)_{a100-b}Al_b$ ($0 \le x \le 1$, $0 \le y \le 0.2$, $0 \le x+y \le 1$, $0 \le z \le 1$, $0.4 \le a \le 0.7$, and $5 \le b \le 20$ at. %), can be configured by adding Al to an alloy having a chemical formula of $(Ti_{1-x-y}Zr_xHf_y)_{1-a}(Nb_{1-z}Ta_z)_a$ in a molar fraction of 5-20 at. % in the entire alloy composition, Al is selectively soluted in a BCC phase with large contents of (Ti, Zr, Hf) to form a B2 phase, which is an ordered BCC phase, so that the microstructure of the alloy is changed into a BCC dual phase composed of a disordered BCC phase and an ordered B2 phase. This is due to the property of Al having a stronger atomic bond with group 4 elements than with group 5 elements, and the B2 phase thus formed has higher strength due to atomic binding properties thereof.

However, 20 at. % or more of Al is not preferable since the intermetallic compounds other than the BCC phase are excessively precipitated in a volume fraction of 30% or more.

The addition of Al in 5 at. % or smaller does not produce a B2 phase forming effect. Therefore, the content of Al is preferably 5-20 at. % of the total alloy composition fraction.

Mo and W have a negative enthalpy of mixing with Zr and Hf, resulting in no great influence on the miscibility gap, but are known to elements that form a complete solid solution together with Nb and Ta and enhance the strength of an alloy, and therefore, the strength of an alloy can be enhanced by replacing the alloy group configured of (Nb, Ta) with Mo and W in 10 at. % or less. The addition of 10 at. % or more may form other intermetallic compounds showing brittleness, and thus the addition of 10 at. % or less is preferable.

In addition, the oxidation resistance can be further improved by adding at least one element selected from the group consisting of (Cr and Si), which have a significantly large affinity with oxygen compared with the constituent elements of the alloy of the present disclosure, in 5 at. % or less. However, a content of (Cr and Si) exceeding 5 at. % is not preferably since additional intermetallic compounds causing brittle fractures are formed in large amounts.

A method for manufacturing an alloy according to the present disclosure comprises: preparing a raw material having a molar ratio of $(Ti_{1-x-y}Zr_xHf_y)_{1-a}$ $(Nb_{1-z}Ta_z)_{a100-b}Al_b$; melting the raw material to prepare an alloy; and controlling a microstructure of the alloy through a subsequent heat treatment process.

In the present disclosure, the subsequent heat treatment step comprises the following two steps. A first step is that a microstructure of a BCC single phase is obtained by homogenization for 1-96 hours at 1300-1600° C. where the BCC single phase is present as a thermodynamic equilibrium phase, followed by quenching. The homogenization within 1 hour may not completely homogenize the composition deviation in the BCC single phase, and the homogenization for 96 hours or longer may delay a precipitation behavior of a second phase at the time of subsequent aging through crystal grain coarsening. Therefore, the above-mentioned times for homogenization are not preferable.

A second step is that aging is carried out at 600-1300° C. for 1-200 hours. It is preferable to carry out quenching after the aging. In the aging step, the single-phase BCC is separated into two BCC phases, and thus a BCC dual phase can be obtained. When the aging time is less than 1 hour, the precipitate phase may be in a metastable phase, and when the aging time is 200 hours or longer, the precipitate phase may coarsen to 100 μm or more or a deterioration may occur through the precipitation of an additional phase. Therefore, the above-mentioned times for aging are not preferable. Especially, the temperature at which the alloys of the present disclosure are subjected to aging may be a temperature equal to or lower than $T_c$ expressed by the following equation according to the composition of an alloy.

$$T_c(K)=881.4+331.7*x+546.7*y+893.0*x*z \ (0 \le x \le 1, 0 \le y \le 0.2, 0 \le x+y \le 1, \text{ and } 0 \le z \le 1)$$

Through this procedure, the microstructure of the BCC dual phase refractory superalloy with excellent high-temperature stability according to the present disclosure can be controlled by customized characteristics.

Table 1 shows microstructures according to the aging process in the alloys having a chemical formula of $(Ti_{1-x-y}Zr_xHf_y)_{1-a}(Nb_{1-z}Ta_z)_{a100-b}Al_b$ in Examples 1 to 11 and Comparative Examples 1 to 6. In the following table, IM represents an intermetallic compound.

TABLE 1

| | x | y | z | a | b | Additional element | Aging conditions | Microstructure |
|---|---|---|---|---|---|---|---|---|
| Example 1 | 0.5 | 0 | 0.5 | 0.55 | 5 | — | 600° C., 24 hours | BCC + B2 |
| Example 2 | 0.5 | 0 | 0.5 | 0.55 | 5 | — | 800° C., 24 hours | BCC + B2 |
| Example 3 | 0.5 | 0 | 0.5 | 0.55 | 5 | — | 1000° C., 24 hours | BCC + B2 |
| Example 4 | 0.5 | 0 | 0.5 | 0.4 | 10 | — | 800° C., 24 hours | BCC + B2 |
| Example 5 | 0.5 | 0 | 0.5 | 0.7 | 10 | — | 800° C., 24 hours | BCC + B2 |
| Example 6 | 0.4 | 0.1 | 0.5 | 0.55 | 20 | — | 800° C., 24 hours | BCC + B2 |
| Example 7 | 0.5 | 0.2 | 0.7 | 0.55 | 10 | — | 800° C., 24 hours | BCC + B2 |

TABLE 1-continued

| | x | y | z | a | b | Additional element | Aging conditions | Microstructure |
|---|---|---|---|---|---|---|---|---|
| Example 8 | 0.5 | 0 | 0.5 | 0.6 | 10 | Cr 5 at. % | 800° C., 24 hours | BCC + B2 |
| Example 9 | 0.5 | 0 | 0.5 | 0.6 | 10 | Si 5 at. % | 800° C., 24 hours | BCC + B2 |
| Example 10 | 0.5 | 0 | 0.5 | 0.6 | 10 | Mo 10 at. % | 800° C., 24 hours | BCC + B2 |
| Example 11 | 0.5 | 0 | 0.5 | 0.6 | 10 | W 10 at. % | 800° C., 24 hours | BCC + B2 |
| Example 12 | 0.5 | 0 | 0.5 | 0.55 | 10 | | 600° C., 120 hours | BCC + B2 |
| Example 13 | 0.5 | 0 | 0.5 | 0.55 | 10 | | 600° C., 24 hours | BCC + B2 |
| Comparative Example 1 | 0.5 | 0 | 0.5 | 0.5 | 0 | — | 800° C., 24 hours | BCC + BCC |
| Comparative Example 2 | 0.3 | 0.2 | 0.5 | 0.3 | 0 | — | 800° C., 24 hours | BCC single phase |
| Comparative Example 3 | 0 | 0.5 | 0.5 | 0.3 | 10 | — | 800° C., 24 hours | BCC single phase |
| Comparative Example 4 | 0.3 | 0.2 | 0.6 | 0.6 | 30 | — | 1000° C., 24 hours | BCC + Multiple IM |

Figure 3:
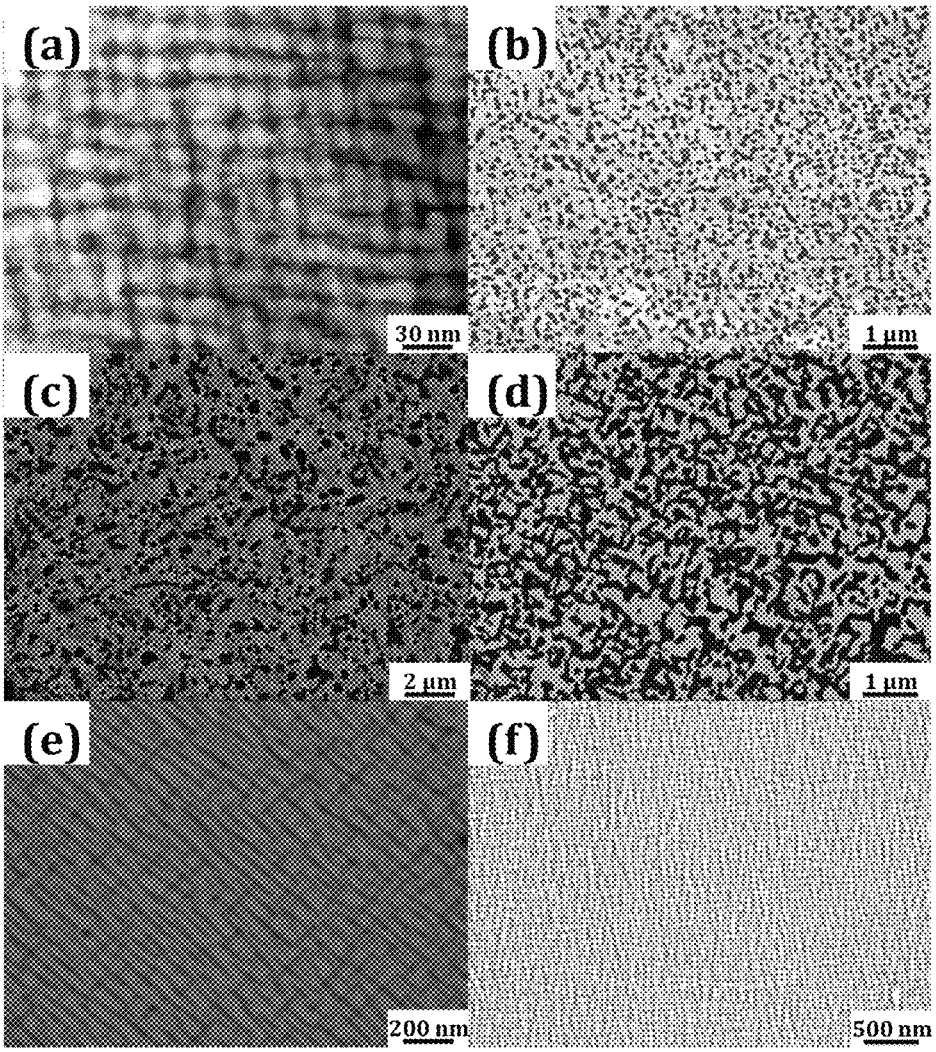
FIG. 3 shows a transmission electron microscopy (TEM) image of the BCC dual phase refractory superalloy with high phase stability in Example 1 (FIG. 3A), and scanning electron microscopy (SEM) images of the BCC dual phase refractory superalloy with high phase stability in Example 2 (FIG. 3B), Example 3 (FIG. 3C), Example 4 (FIG. 3D), Example 5 (FIG. 3E), and Example 6 (FIG. 3F)

FIG. 3 shows a transmission electron microscopy (TEM) image of the alloy of Example 1 (FIG. 3A), and scanning electron microscopy (SEM) images of the alloys of Example 2 (FIG. 3B), Example 3 (FIG. 3C), Example 4 (FIG. 3D), Example 5 (FIG. 3E), and Example 6 (FIG. 3F). In all the images, the phases having a bright contrast are disordered BCC phases and the phases having a dark contrast are B2 phases as ordered BCC phases. In Example 1, cubic structured BCC precipitates with an average level of 10-20 nm were formed by a relatively low aging temperature of 600° C., and it can be seen from the transmission electron microscopy diffraction pattern that disordered BCC phases (A2) and ordered BCC phases (B2) are present together. It can be therefore seen that Example 1 had a BCC dual phase in which disordered BCC phases and B2 phases as ordered BCC phases are present together.

The alloys of the present disclosure are characterized in that depending on the configuration and aging process, disordered BCC phases or ordered B2 phases are present together in a precipitate form as in Example 3 and Example 6, or two phases had an interconnected structure by spinodal decomposition as in Example 4 and Example 5.

Figure 4:
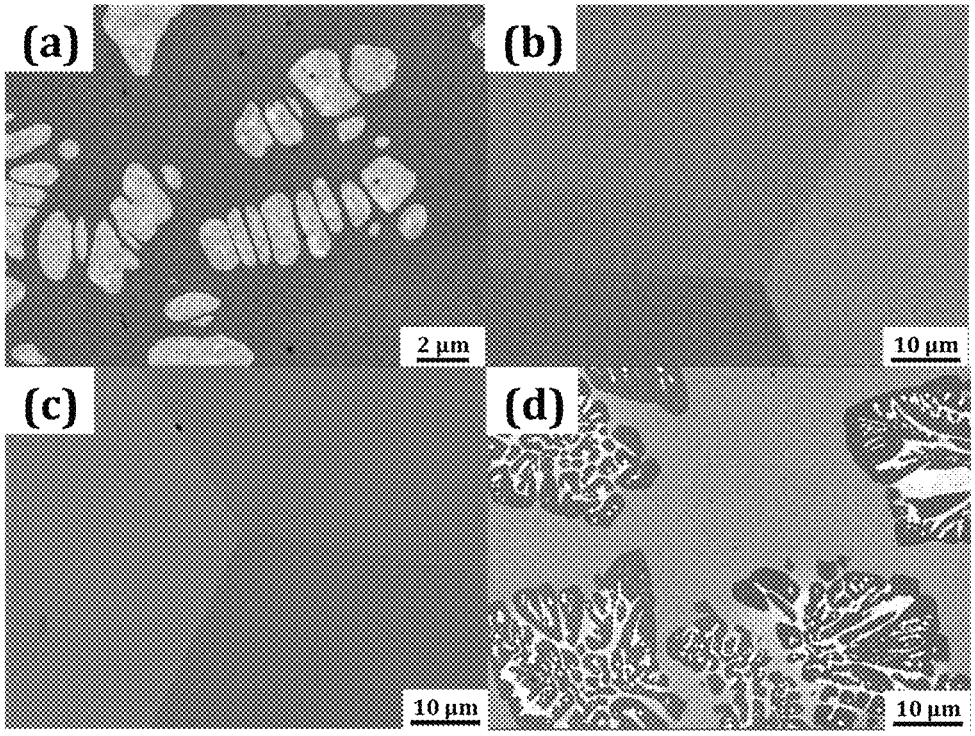
FIG. 4 shows scanning electron microscopy (SEM) images of the alloys of Comparative Example 1 (FIG. 4A), Comparative Example 2 (FIG. 4B), Comparative Example 3 (FIG. 4C), and Comparative Example 4 (FIG. 4D)

Such a microstructural tendency is also shown in the same manner in Examples 7 to 11. FIG. 4 shows scanning electron microscopy (SEM) images of the alloys of Comparative Example 1 (FIG. 4A), Comparative Example 2 (FIG. 4B), Comparative Example 3 (FIG. 4C), and Comparative Example 4 (FIG. 4D). In Comparative Example 1, two BCC phases were separated by the BCC phase miscibility gap as described above, but both of the two phases had a disordered BCC structure due to the non-addition of Al, and thus did not exhibit high strength.

In Comparative Examples 2 and 3, the compositions thereof were located significantly away from the apex of the BCC miscibility gap due to low (Nb, Ta) contents, with the result that the aging temperature, 800° C., was located higher than the miscibility gap, and thus the BCC single phase structure was formed.

Comparative Example 4 was not preferable as a structural material since intermetallic compounds causing brittle fractures in the BCC matrix were precipitated in large amounts due to a high Al content of 30 at. %.

Figure 5:
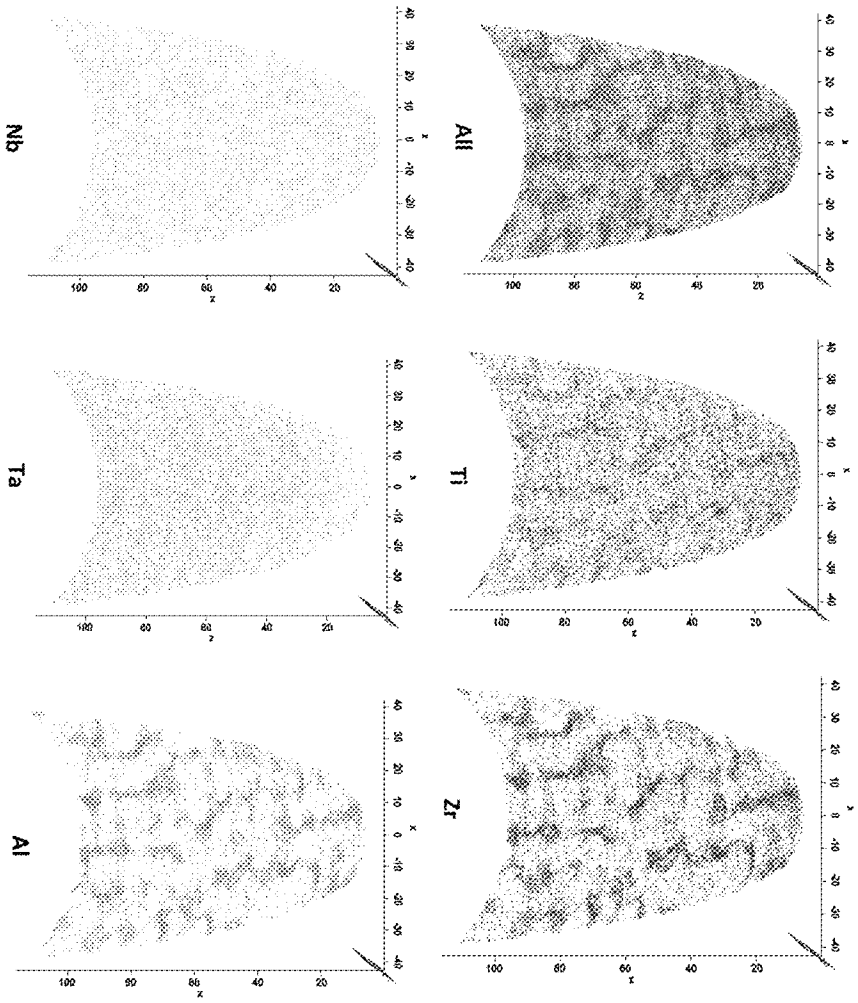
FIG. 5 shows atom probe tomography (APT) analysis results of BCC dual phase refractory superalloy with high phase stability in Example 1.

FIG. 5 shows atom probe tomography (APT) analysis results of the BCC dual phase refractory superalloy with high phase stability in Example 1. As described above, Al was selectively soluted in the separated (Ti, Zr) phase, which was a B2 phase as an ordered BCC phase. The B2 phases having high contents of Ti, Zr, and Al were connected to have a continuous form, and it can be therefore seen that the BCC dual phase refractory superalloy with high phase stability in Example 1 had a disordered BCC phase as a cube-shaped nanoprecipitate and an ordered BCC phase, B2 phase, as a matrix.

Figure 6:
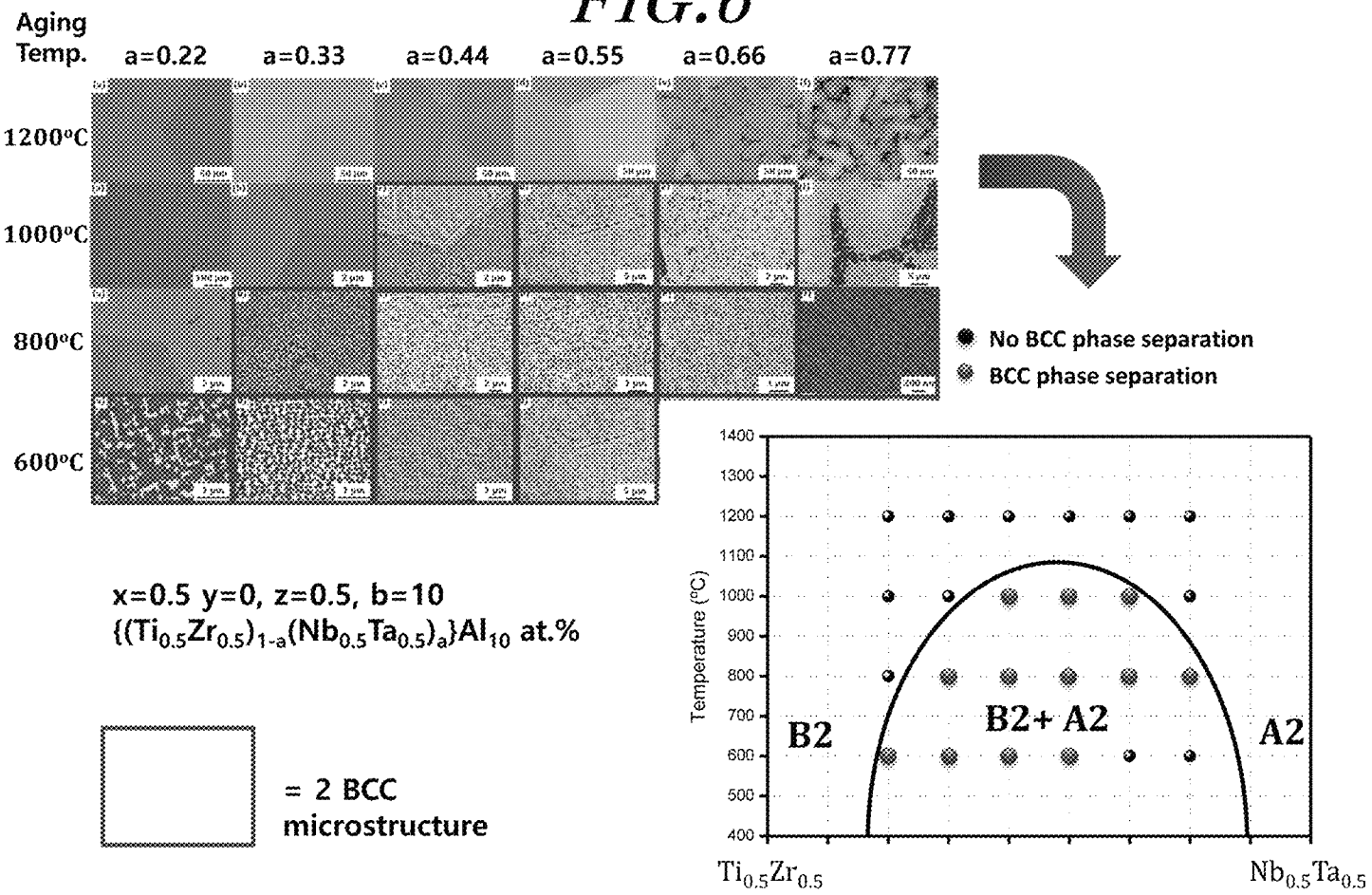
FIG. 6 shows microstructures of superalloys according to the a value and the aging temperature and a schematic diagram of the resultant miscibility gap, in the pseudo-binary phase diagram of the $((Ti_{0.5}Zr_{0.5})_{1-a}(Nb_{0.5}Ta_{0.5})_a)_{90}Al_{10}$ alloy system in which x=0.5, y=0, z=0.5, and b=10 at. % of the present disclosure.

FIG. 6 shows microstructures of alloys according to the a value and the aging temperature and a schematic diagram of the resultant miscibility gap, in the pseudo-binary phase diagram of the $((Ti_{0.5}Zr_{0.5})_{1-a}(Nb_{0.5}Ta_{0.5})_a)_{90}Al_{10}$ alloy system in which x=0.5, y=0, z=0.5, and b=10 at. % of the present disclosure. The microstructures for respective compositions and aging temperatures shown in FIG. 6 were analyzed to distinguish the separation or non-separation of the BCC phase, thereby designing a pseudo-binary phase diagram of the alloy system configured of the composition, so that the position of the miscibility gap located in the pseudo-binary phase diagram can be drawn as shown in FIG. 6. In the pseudo-binary phase diagram of the $((Ti_{0.5}Zr_{0.5})_{1-a}(Nb_{0.5}Ta_{0.5})_a)_{90}Al_{10}$ alloy system in which x=0.5, y=0, z=0.5, and b=10 at. %, the apex ($T_c$) value of the miscibility gap predicted by the above equation was 1270.5 K (about 1000° C.), which was similar when compared with the miscibility gap drawn through actual experiment results. According to the present disclosure, in the alloys having compositions of a=0.44, 0.55, and 0.66, contained in the composition ($0.4 \le a \le 0.7$) around the $X_{Tc}$ located in 0.5-0.6, the BCC dual phase structure was stable up to a high aging temperature of 1000° C.

The BCC dual phase refractory superalloy with high phase stability according to the present disclosure has a microstructure containing both of two BCC phases, wherein the precipitated BCC phase has an average particle size of 0.01-100 μm. When the size of the precipitated BCC phase is smaller than 0.01 μm, such a size is not suitable to delay crack propagation and thus the enhancement in strength by precipitation is not great. When the size of the precipitated BCC phase is larger than 100 μm, the coarsening of the precipitated particle size may result in a brittle fracture tendency. Therefore, the above-mentioned sizes of precipitated particles are not preferable.

Figure 7:
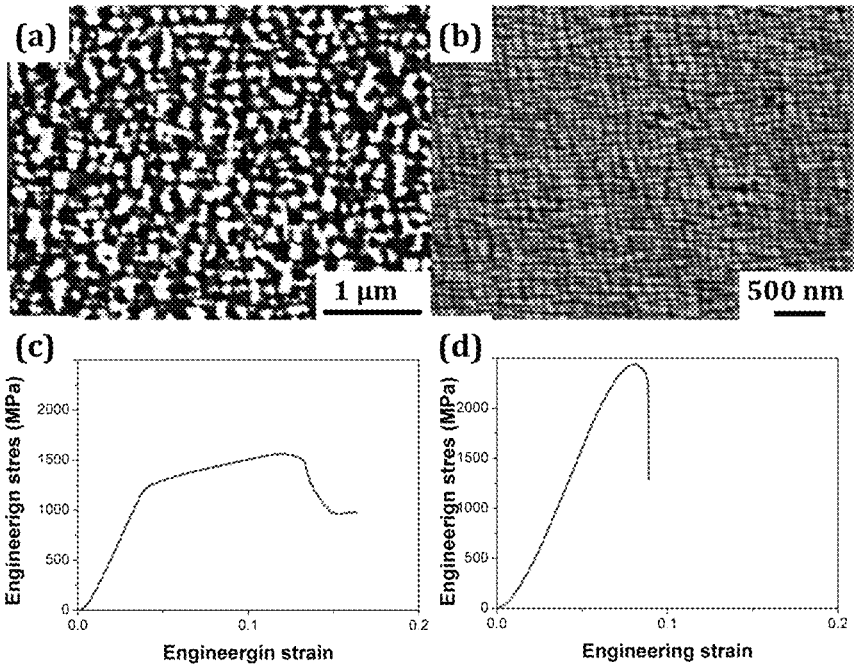
FIGS. 7A and 7B are scanning electron microscopy (SEM) images of the alloys in Examples 12 and 13, respectively.
FIGS. 7C and 7D are graphs showing the room temperature compression test results of the alloys in Examples 12 and 13.

FIGS. 7A and 7B are scanning electron microscopy (SEM) images of the alloys in Examples 12 and 13, respectively, and FIGS. 7C and 7D are graphs showing the room temperature compression test results of the alloys in Examples 12 and 13. Examples 12 and 13 show a difference in precipitate size according to a difference in aging time (120 hours and 24 hours) at the same aging temperature (600° C.).

In a case where the average particle size was 0.1 μm or larger as in Example 12, relatively excellent elongation characteristics can be obtained as can be seen from FIG. 7C.

In a case where the average particle size was 0.1 μm or smaller as in Example 13, relatively high strength can be obtained as can be seen from FIG. 7D.

As described above, according to the alloys of the present disclosure, the strength and elongation characteristics can be controlled to be customized by adjusting the size of the precipitated BCC phase particles by an aging method.

What is claimed is:

1. A BCC dual phase refractory superalloy, which comprises one or more of Ti, Zr, and Hf as Group 4 transition metals, one or more of Na and Ta as Group 5 transition metals, and Al, and has a structure of a BCC phase, wherein the BCC phase is composed of a disordered BCC phase and an ordered BCC phase, and wherein the ordered BCC phase is formed by allowing Al, which is a BCC phase forming element, to be soluted in an area of the BCC phase where the contents of the Group 5 transition metals are more than those of the Group 4 transition metals, wherein the BCC dual phase refractory superalloy complies with a composition of ((Ti1-x-yZrxHfy)1-a(Nb1-zTaz)a)100-bAlb($0\le x\le 1$, $0\le y\le 0.2$, $0\le x+y\le 1$, $0\le z\le 1$, $0.4\le a\le 0.7$, and $5\le b\le 20$ at. %).

2. The BCC dual phase refractory superalloy of claim 1, which has an apex temperature (Tc) of a BCC phase miscibility gap, expressed by (Equation 1) below:

$$Tc(K)=881.4+331.7*x+546.7*y+893.0*x*z \text{ (provided that, } 0\le x\le 1,\ 0\le y\le 0.2,\ 0\le x+y\le 1, \text{ and } 0\le z\le 1). \quad \text{(Equation 1)}$$

3. The BCC dual phase refractory superalloy of claim 2, which is formed by a composition of (Equation 2) below and has high phase stability at high temperatures in a BCC dual phase due to the apex temperature (Tc) of the BCC phase miscibility gap being 800° C. or higher.

$$((Ti1\text{-}x\text{-}yZrxHfy)1\text{-}a(Nb1\text{-}zTaz)a)100\text{-}bAlb \text{ (provided that, } 0.3\le x\le 1,\ 0\le y\le 0,\ 0\le x+y\le 1,\ 0.4\le z\le 1,\ 0.4\le a\le 0.7, \text{ and } 5\le b\le 20 \text{ at. \%}) \quad \text{(Equation 2)}$$

4. The BCC dual phase refractory superalloy of claim 2, which is formed by a composition of (Equation 3) below and has a BCC dual phase with high phase stability at ultra-high temperatures due to the apex temperature (Tc) of the BCC phase miscibility gap being 1000° C. or higher.

$$((Ti1\text{-}x\text{-}yZrxHfy)1\text{-}a(Nb1\text{-}zTaz)a)100\text{-}bAlb \text{ (provided that, } 0.5\le x\le 1,\ 0\le y\le 0.2,\ 0\le x+y\le 1,\ 0.5\le z\le 1,\ 0.4\le a\le 0.7, \text{ and } 5\le b\le 20 \text{ at. \%}) \quad \text{(Equation 3)}$$

5. The BCC dual phase refractory superalloy of claim 2, wherein the BCC dual phase is formed with an ordered BCC phase and a disordered BCC phase separated from each other through a spinodal decomposition behavior.

6. The BCC dual phase refractory superalloy of claim 1, wherein the ordered BCC phase has an average particle size of 0.01-100 μm, and thus the strength and elongation of the refractory superalloy are controllable according to the size of a precipitate phase.

7. A BCC dual phase refractory superalloy, which comprises one or more of Ti, Zr, and Hf as Group 4 transition metals, one or more of Na and Ta as Group 5 transition metals, and Al, and has a structure of a BCC phase, wherein the BCC phase is composed of a disordered BCC phase and an ordered BCC phase, wherein the ordered BCC phase is formed by allowing Al, which is a BCC phase forming element, to be soluted in an area of the BCC phase where the contents of the Group 5 transition metals are more than those of the Group 4 transition metals, wherein the BCC dual phase refractory superalloy comprises a composition of ((Ti1x-yZrxHfy)1-a(Nb1-zTaz)a)100-bAlb ($0\le x<1$, $0\le y\le 0.2$, $0\le x+y\le 1$, $0\le z\le 1$, $0.4\le a\le 0.7$and $5\le b\le 20$at. %), and wherein 10 at. % or less of (Nb and Ta) are replaced by (Mo and W).

8. A BCC dual phase refractory superalloy, which comprises one or more of Ti, Zr, and Hf as Group 4 transition metals, one or more of Na and Ta as Group 5 transition metals, and Al, and has a structure of a BCC phase, wherein the BCC phase is composed of a disordered BCC phase and an ordered BCC phase, and wherein the ordered BCC phase is formed by allowing Al, which is a BCC phase forming element, to be soluted in an area of the BCC phase where the contents of the Group 5 transition metals are more than those of the Group 4 transition metals, wherein the BCC dual phase refractory superalloy comprises a composition of ((Ti1-x-yZrxHfy)1-a(Nb1-zTaz)a)100-bAlb ($0\le x<1$, $0\le y\le 0.2$, $0\le x+y\le 1$, $0\le z\le 1$, $0.4\le a\le 0.7$, and $5\le b\le 20$ at. %, wherein one or more elements selected from the group consisting of Cr and Si are added in 5 at. % or less compared with the entire alloy composition to improve oxidation resistance.

* * * * *